United States Patent [19]

Plote

[11] 4,005,851

[45] Feb. 1, 1977

[54] HYDRAULICALLY OPERATED DRILLING APPARATUS

[75] Inventor: Hans-Otto Plote, Vohrum, Germany

[73] Assignee: Werner Nordmeyer Ing. Erben KG, Peine-Handorf, Germany

[22] Filed: Nov. 26, 1974

[21] Appl. No.: 527,361

[30] Foreign Application Priority Data

Dec. 7, 1973 Germany ..... 2361050

[52] U.S. Cl. ..... 254/139; 173/147

[51] Int. Cl.[2] ..... B66C 23/60

[58] Field of Search ..... 254/139, 148, 189, 139.1; 240/88; 187/81, 9, 27; 182/149, 189; 173/147; 52/40; 114/112; 212/144

[56] References Cited

UNITED STATES PATENTS

| | | | |
|---|---|---|---|
| 2,186,720 | 1/1940 | Edwards | 254/139 |
| 2,676,677 | 4/1954 | Anderson et al. | 254/139 |
| 2,868,019 | 1/1959 | Bull | 173/147 |
| 3,396,946 | 8/1968 | Maddock | 254/189 |
| 3,535,985 | 10/1970 | Attebo | 173/147 |
| 3,684,035 | 8/1972 | Wills | 173/147 |
| 3,732,935 | 5/1973 | Gibson | 173/147 |
| 3,738,433 | 6/1973 | O'Leary | 173/147 |
| 3,835,940 | 9/1974 | Winter, Jr. | 173/147 |

*Primary Examiner*—Robert J. Spar
*Assistant Examiner*—Kenneth Noland

[57] ABSTRACT

A hydraulically operated drilling apparatus having a main mast on which an extension is mounted having a rope winch or the like for operating a rotary drilling head or power capstan. The drilling head is guided on a pair of diametrically opposed rails fixed on the outer circumference of the mast along its entire length and is pulled by a cable of a block and tackle system activated by a hydraulic power drive located within the mast. The cable of the block and tackle system which in part runs on the exterior of the mast passes into the mast and is caused to run over a movable pulley sheave secured at each end of the mast. The sheaves at the end of the mast are mounted on bearings which also anchor the cable, which bearings are securely and integrally formed with end caps or covers, sealing the end of the mast.

12 Claims, 4 Drawing Figures

HYDRAULICALLY OPERATED DRILLING APPARATUS

BACKGROUND OF THE INVENTION

The present invention relates to hydraulically operated drilling apparatus and the like and in particular to an arrangement of such apparatus in a portable mast or vertical standard.

Portable hydraulically operated drilling apparatus on which the rotary drilling head or capstan is mounted is known. Drilling rods, held by the capstan, extend downwardly though a slip or guide device in a direction parallel to the mast. The drill-head is operated by a rope winch mounted on the upper end of the mast or on an extension thereof and is moveable along the length of the mast by a cable and pulley system activated by a hydraulic motor.

The mast must be of such a form that it has sufficient rigidity and resistance to bending and twisting so as to accurately carry the drilling head. However, it must be without excessive weight since a light weight mast is important for portable apparatus, intended to be mounted upon standard vehicles or trucks. In addition, the mast must be of such construction that the individual parts arranged and mounted on it can be easily reached in order to be repaired and serviced.

Various embodiments of the formation of the mast have been known. In one instance, the mast is formed as a lattice, or open frame work rig, the rigidity of which is insured by using slant bracings and cross bracings. With this open type rig the parts can be easily serviced. In another embodiment the mast may be made from identically profiled steel beams, as for instance when a pair of double-T-profile beams (H beams) are arranged in parallel spaced position opposite each other and are welded together with the plurality of cross plates. The edges of the beams in this arrangement which lie on a common plane can thus form the buter guide rail for the drill head as well as the means for attaching the slip or guide device. However, in this form, the ability to serve and clean the parts of the apparatus which are arranged within the beam construction is extremely difficult because of the narrow space between the members.

In any event, whether the mast is formed of a lattice type rig, or a welded box-like frame, a great many manufacturing steps are required to form the mast. It is therefore expensive to provide the masts of the prior art. Furthermore, the numerous bracings and other constructional materials render the masts extremely heavy. Still further, when the mast is formed of steel rails, for instance the two double-T beams or even from a pair of oppositely oriented U-beams, masts of very large dimensions are obtained increasing the weight and requiring considerably complex mechanisms for mounting the same upon the vehicles.

It is the object of the present invention to provide a hydraulically actuated drilling apparatus which overcomes the disadvantages and difficulties of the prior art.

It is a further purpose of the present invention to provide a mast for hydraulically operated drilling apparatus which is simpler and cheaper to manufacture and which has an extraordinarily low weight and a particularly high resistance to buckling or bending in addition to a strong resistance against turning moments.

It is another object of the present invention to provide a hydraulically actuated drill having an improved mast in which substantially all the operating parts may be housed and yet provides ample room and ability for repair and servicing.

The foregoing objects, other objects, together with the numerous advantages of the present invention will be apparent from the following disclosure.

SUMMARY OF THE INVENTION

According to the present invention, a hydraulic actuated drill apparatus is provided with a hollow cylindrical mast on which a rotary power drill head is adapted to be mounted for movement along its length. The apparatus is further provided with a hydraulically actuated cable pulley system for driving the drill head which comprises the hydraulic motor having a moveable member arranged within the mast. A first sheave is attached to the moveable member and a pair of second sheaves are adapted to be respectively located at each end of the mast. Each of the second sheaves is journalled on bearing means integrally fixed to a cover or lid which is securely fastened at the respective ends of the mast. The bearing means also include means for anchoring ends of the cable. The cable extends in part along the exterior of the mast and in part within said mast being entrained over the first and second sheaves to cause the drill head to move along the mast on actuation of the hydraulic motor.

Preferably, the mast is made of steel pipe of circular cross-section, having guide rails formed along its length diametrically opposite each other on the outer surface. An advantage of this construction lies in the fact that the drill head can be formed with a saddle-like carriage, encircling the surface of the mast and being guided by the longitudinal rails so that the drill head will be securely mounted and will be prevented from twisting or canting under load conditions. A further advantage lies in the provision of the bearing means integrally with the covers or lids fixed to the ends of the mast. The covers strengthen the cylindrical mast, and enclose the ends while providing strong bracings and anchors for the sheaves as well as for the cable. As a result, the mast may be manufactured out of inexpensive and commercially available piping or cylindrical tubes of a generally lower quality than would have been expected. Commercial piping, formed of steel plate which is longitudinally or spirally welded, are especially suited. Such cylindrical pipe need only small manufacturing steps in order to adapt them to the construction of the mast. It is particularly possible to arrange the sheaves of the pulley system within the cylindrical pipes, by means of the closing covers and lids, without complex or expensive manufacturing steps. Furthermore, the cylindrical pipe may be provided with one or more openings for access to the pulley system and the cables, without weakening the strength of the mast.

Furthermore, the mast, according to the present invention, being hollow, permits the arrangement of the pulley system and cable, as well as the hydraulic motor means, in its interior so that the danger of these parts becoming dirty is greatly reduced and therefore the need for servicing and replacement of parts is significantly avoided. The mast, being an elongated cylinder, is extraordinarily resistant to any turning moment or twisting. It also has a high resistance to tilting and bending under a great load condition. Accordingly, the rails which are adapted to guide the drilling head, need be chosen only with this purpose in mind. Since they need not serve to increase the strength of the mast, they may be simply and inexpensively fabricated. Because of the high resistance to any turning moment, the mast can be made extremely light so that the total weight of the entire apparatus is greatly reduced although a high degree of rigidity is still maintained. The mast is therefore especially suitable for moveable drilling apparatus, adapted to be mounted on road vehicles or the like. Preferably, the hydraulic motor means comprises a pressure cylinder and a piston. The anchoring of the pressure cylinder within the interior of the mast can also be obtained in a very simple manner, by united two elongated segments with a middle, shorter cylindrical segment. A bearing for the pressure cylinder can be welded into the interior surface of the middle cylindrical segment and the pressure cylinder can be removeably mounted therein. The middle cylindrical segment may in addition made rigid by the inclusion of reinforcement plates or rigs. One or more windows or openings, assuring accessibility to the interior of the cylindrical mast, for inspection and servicing purposes can be made between the reinforcement plates. Such window construction would not weaken the strength of the mast, since it is arranged in a reinforced short cylindrical section, which also carries the pressure cylinder, adding to a greater strength and rigidity.

Complex manufacturing steps, in fabricating the mast, are not necessary. The mast need not otherwise be provided with strengthening means or complex auxiliary equipment. The hose or conduit connections for the pressure cylinder can be easily brought into the mast through the covers or lids, or through small openings in the circumference of the mast itself. The only other openings in the mast are those through which the cable will extend and these openings are at the extreme ends of the mast adjacent the second sheaves.

Full details of the present invention are given in the following description and are shown in the accompanying drawing.

DESCRIPTION OF THE INVENTION

Figure 1:
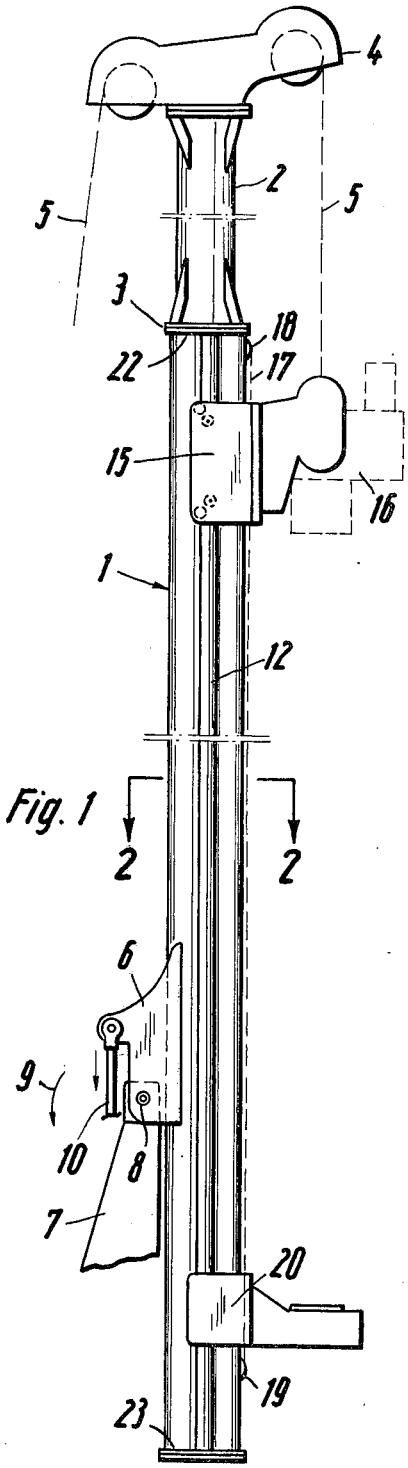
FIG. 1 is a side elevational view of the mast and hydraulically operated drilling apparatus, embodying the present invention.

As seen in FIG. 1 the portable drilling apparatus of the present invention comprises a main mast, generally depicted by the numeral 1, on which extension 2 is hingedly or removeably mounted, as indicated by the numeral 3. The extension may be welded, or secured by bolt or other fastening means to the end of the mast which, as will be described later, is provided with a cover or cap at the same end. The mast extension 2 carries a head 4 having a winch system over which a cable 5 is entrained for conventionally operating the rotary power capstan or the drilling system.

The mast 1 is adapted to be mounted on a truck or chassis or vehicle so as to be tiltable between a generally vertical position, as shown in the FIG. for operation, and a horizontally folded position for travel. To this end, a holder 6 is secured to the main mast section 1, adjacent its lower end. The holder 6 is pivotally secured to a tripod or supporting leg 7 which is fixedly mounted on the vehicle by an axle pin 8 which is journalled in a horizontal axis. The swinging and uprighting of the mast is accomplished in known manner by pivoting the mast in an arc, indicated by the arrow 9, as for example, by the use of a hydraulic or pnuematic motor, the extending piston 10 of which, is illustrated in FIG. 1.

The main mast section 1 is formed from a hollow tube having a circular cross section. Conventional cylindrical steel tubing, formed with a longitudinal or even spirally welded seam may be used. Such tubes, generally made from rigid plate, form rigid elongated members having sufficient strength for the intended drilling purposes. Advantageously therefore, commerically sized pipes of inexpensive and low quality variety may be used. In general the extension 2 to the mast can be formed in the same manner as the main mast section, although the form of its construction is not critical to the present invention and it may be therefore varied as desired.

Figure 3:
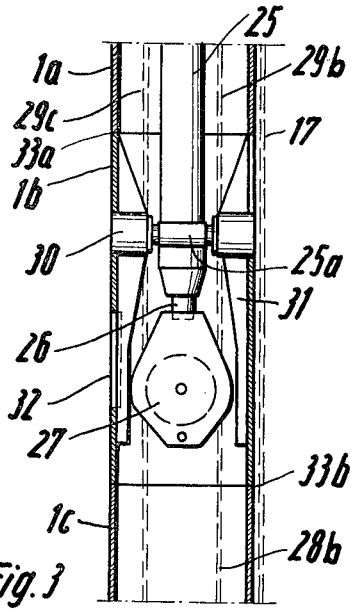
FIG. 3 is an enlarged vertical sectional view through the center of the mast shown in FIG. 1.
Figure 4:
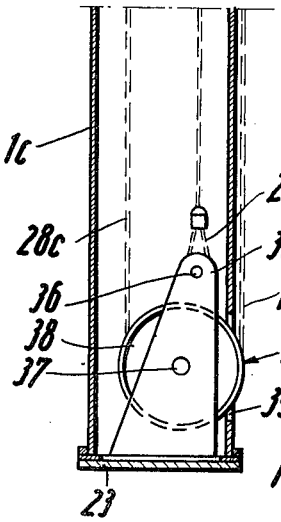
FIG. 4 is a view similar to that of FIG. 3 showing the lower end of the mast.

As seen in FIGS. 3 and 4 the tubular cylindrical body comprising the main mast section may be made from a plurality of smaller sections which are welded together along a common central axis. In the illustrated example, the main mast is formed having an upper section 1*a*, a middle short section 1*b* and a lower section 1*c*. However, the tubular mast can be made of more than or less than three sections as would be desired in any particular embodiment. The abutting edges, depicted by the numerals 33*a* and 33*b*, can in any event be secured together by welding a circumferential seam at the abutting edges. They may also be secured together otherwise than by welding, as for example, by radially enlarging and correspondingly narrowing the adjacent abutting edges so that two members forceably telescope one inside the other, or the ends may be provided with bayonet connection. If desired, the telescoping or bayoneting ends may be welded, bolted or otherwise unitarily fastened to each other so as to form a single integral hollow mast substantially uniform along its entire length.

Figure 2:
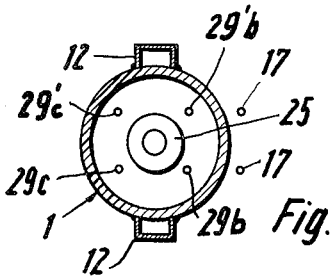
FIG. 2 is a sectional view taken along line 2—2 of FIG. 1.

A pair of diametrically arranged guide rails 12 are welded to the outer surface of the main mast section extending longitudinally from one end to the other. In the illustrated embodiment, the guide rails have a U-shaped profile (FIG. 2), both legs of which are being welded to the surface of the mast. Other beam sections or rails of other cross-sections may be used as desired. A saddle shaped carriage 15, semi-circularly surrounding the main mast, is moveable mounted on the guide rails 12, being provided with suitable rollers engaging opposite surfaces of the rails so that it easily rolls there along without tilted or canting. A rotary power drilling head, or capstan, is mounted on the carriage 15, as indicated by the dotted outline, in known structural and functional manner. The drill head is adapted to hold an elongated drill rod (not shown) and is moveable together with the carriage 15 along the surface of the mast being driven by a hydraulically actuated cable pulley system, a section of which 17, is attached to the carriage 15 and runs along and parallel to the outer surface of the mast. In the illustrated embodiment the pulley or tackle system employs a pair of parallel cables, shown in FIG. 2 by the numeral 17 and 17', although only a single cable is necessary. As seen in FIG. 1 the cable, attached to the carriage 15, passes over a sheaveblock 18 journalled within the upper end of the mast and a sheave block 19 journalled within the lower end of the mast, passing into the mast wherein the remainder of the pulley system and the hydraulic activating means are located. The movement of the carriage 15, downwardly, is limited by a stop or abutment 20 which also provides a slip or guide means for the drill rod. The abutment stop 20 is adjustably secured to the mast and is guided on the rails 12 by the use of suitable screws, bolts, pins or the like so that it may be positioned along the length of the mast at a selected height above the ground. The upper and lower ends of the main mast section 1 are enclosed by cover or lid members 22 and 23 respectively which may themselves be welded or secured by means of bolts or other means to the ends of the mast. As will be explained further herein, the sheave blocks 18 and 19 are integrally secured to the respective cover members 22 and 23.

The means for driving the power drilling head 16 along the length of the mast is located within the interior of the mast 1 as seen in greater detail in FIGS. 3 and 4. This apparatus comprises a hydraulically actuated motor, namely a pressure cylinder 25 arranged coaxially within the mast having a downwardly extending piston rod 26. A double sheave block 27 is secured at the end of the piston rod so as to be conjointly moveable with it. The sheave blocks 18 and 19, form a part of this system and themselves contain double sheaves over which each of the cable sections 17 and 17' are connected.

The sheave blocks 18 and 19 are identical in construction, each is integrally formed with the end cover or lid, or is bolted directly to it. As seen in FIGS. 4 the pulley block 19 comprises a plurality of parallel spaced triangular supporting plates 35, secured at their lower or foot edges to the cover member 23. An anchoring pin 36 is secured, along a horizontal axis, through the upper end of the plates 35 while a sheave axle 37 is journalled about a central portion of the plate. A sheave is journalled on the axle 37 between each of the parallel plates 35. Although the sheave block 19 contains a plurality of such sheaves, only one, indicated by the numeral 38, is seen in the drawing. An opening 39 is made in the wall of the mast, adjacent its end so that the peripheral edge of the sheave 38 can extend beyond the surface of the mast, allowing the cables 17 and 17' to pass into the interior of the mast and onto the respective sheaves.

One end of each of the cables 17 and 17' is provided with an eye **28*a* which is secured about the anchoring pin 36. The cable then extends in a section 28*b* upwardly about the sheave block 27 which is moveable conjointly with the piston 26 of the hydraulic motor. The cable then runs downwardly in a section 28*c* about the sheave 38 of the lower fixed block 19, outwardly of the opening 39 to form the exposed section 17 running parallel to the face of the mast. The section 17 is attached to the carriage 15 and then returns into the mast through the opening at the upper end of the mast passing over the corresponding sheave in the upper fixed block 18. It then passes downwardly in a section 29*c*, about an adjacent second sheave on the block 27 from which it thereafter turns upwardly in a section 29*b* so as to be anchored by a similar eye end on an anchoring pin located in the upper fixed block 18**. The cable system which is shown as comprising a pair of parallel tackles have the advantage of symmetry and of sharing a load and force conditions while moving the power capstan. Such a parallel system is, however, not essential, as clearly one cable system will function as well.

The lower end of the pressure cylinder 25 is provided with an annular supporting head or collar **25*a* which is itself supported in a bearing ring 30 preferably welded to the inner wall of the central short mast section 1*b*. The pressure cylinder 25 is held in this position coaxially along the center of the mast and extends upwardly freely of the walls of the mast. The middle section 1*b* is furthermore strengthened by a plurality of sheet metal plate-like ribs 31 which are also preferably welded to the inner wall surface. Centering shims, bolts, or other means can be removeably fixed at the upper end of the mast to hold the cylinder 25 in the upright position along the center line. The sheave block 27** is securely fastened to the end of the piston rod by suitable bolts or screws so that it is conjointly moveably with the piston rod but in like manner can be easily removed therefrom for replacement.

One or more openings 32 are provided between adjacent ones of the strengthening ribs 31 so that access through the middle section **1*b* of the mast can be obtained for servicing of the sheave block 27, the cables or the cylinder and piston system. Under normal operating conditions the openings 31 may be covered by a suitable transparent glass or plastic windown so that the interior of the mast may be enclosed. The openings 39 at the lower and upper end of the mast permit access the sheave blocks 18 and 19** respectively.

Conduits, such as piping or hosing, for the delivery or removal of the pressurized medium operating the pressure cylinder 25 can be connected through the upper cover member 22, or through small openings formed in the central mast section **1*b* adjacent the cylinder head 25*a* and/or at the upper end of the mast adjacent the upper end of the cylinder 25**. Conventional conduits, valving controls and other mechanism for controlling the drilling operation are used as is necessary.

The cross-section of the guide rail 12 is indicated as being preferably U-shaped, so as to have all outer profile which is rectangular. It will be understood that other forms of rails, such as solid rail, a T-beam, or the like may be used. Furthermore, as used herein, the term sheave is intended to mean roller or wheel means about which a cable can be easily entrained as in a pulley system. Single sheaves defining an independent track for the cable may be used and where used in combination with other sheaves in a block can be mounted along a common axle. On the other hand, a cylindrical roller with or without tracking means may also be employed. The term cable as used herein may include a rope, a steel cable, or a chain. Where a chain is used as a cable, the sheaves or rollers can if desired be replaced with sprocket or cog wheels. Further, in this instance, the pressure cylinder 35 forming the hydraulic motor means could be replaced with a cog or chain drive hydraulic motor having linear or rotary moveable member.

Various changes, modifications and embodiments have been suggested above, others will be obvious to those skilled in the present art. Accordingly, it is intended that the present disclosure be taken as illustrative only of the present invention and not as limiting of its scope.

What is claimed is:

1. Drilling apparatus comprising an elongated hollow mast formed of a plurality of axially arranged steel pipe sections of circular cross-section secured together in tandem at their abutting ends to form a vertical mast with one section above the other, cover means located at each end of said mast to enclose the same, a drill head moveably mounted on the exterior of said mast, an elongated cable attached to said drill head extending along the length of said mast, and means located within said mast to pull said cable moving said drill head along the length of said mast, said pulling means comprising a pressure operated cylinder/piston motor located within a central one of said steel pipe sections and having a moveable member attached to said cable, first sheave means secured to said moveable member, and second sheave means located respectively within the end sections of said mast, each of said second sheave means being journalled in a bearing secured to the respective cover means, and said cable being entrained over said first and second sheave means and anchored at its ends to the respective bearing means whereby the forces exerted by the movement thereof are absorbed within said mast.

2. The apparatus according to claim 1 wherein said mast includes a pair of integral guide rails extending longitudinally along its outer surface and being diametrically opposed into each other, said drill head having means for moveably engaging said rails and being guided thereon along said mast.

3. The apparatus according to claim 1 including a mast extension hingedly mounted on an end of said mast, a rope winch located on said extension and connected to said drill head for operating said drill head.

4. The apparatus according to claim 1 wherein said mast is formed from steel sheet having a longitudinal weldment.

5. The apparatus according to claim 1 wherein said mast is formed of steel sheet having a spiral weldment.

6. Drilling apparatus comprising a hollow mast formed of at least three axially abutting cylindrical sections, the central one of which is substantially shorter than the other two, cover means located at each end of said mast to enclose the same, a drill head moveably mounted on the exterior of said mast, an elongated cable attached to said drill head extending along the length of said mast, means for pulling said cable to move said drill head along the length of said mast, said pulling means comprising a motor journalled in bearing means located in the central one of said sections, said motor having a moveable member, first sheave means secured to said moveable member, and second sheave means located at each end of said mast, said second sheave means being journalled in a bearing secured to the respective cover sheave means and said cable being anchored at its ends to the respective bearing means.

7. The apparatus according to claim 6 wherein the axially abutting ends of said cylindrical sections are telescopingly fit within each other.

8. The apparatus according to claim 6 wherein said motor comprises a hydraulic cylinder and piston, one end of said cylinder being held in said bearing means and extending coaxially within said mast free of contact therewith.

9. The apparatus according to claim 6 wherein said mast is provided with at least one opening along its length for access to said cable and sheaves.

10. The apparatus according to claim 6 wherein said central section of said mast is provided with vertical reinforcements and a closeable window means arranged between said adjacent reinforcements for service entry.

11. The apparatus according to claim 6 including a second cable parallel to said first mentioned cable and first and second sheave means corresponding thereto, said first and second sheave means corresponding to said second cable being arranged in common blocks with the respective first and second sheave means corresponding to the first mentioned cable.

12. The apparatus according to claim 6 wherein said drill head is provided with a carriage having a curved saddle surface conforming to the curvature of said mast.

* * * * *